US007658045B2

(12) United States Patent
Elliott et al.

(10) Patent No.: US 7,658,045 B2
(45) Date of Patent: Feb. 9, 2010

(54) WALL STRUCTURE FOR PROTECTION AGAINST WIND-CAUSED UPLIFT

(75) Inventors: A. Carleton Elliott, Newport Beach, CA (US); Kelly P. Holcomb, Huntington Beach, CA (US)

(73) Assignee: Specialty Hardware L.P., Newport Beach, CA (US)

( * ) Notice: Subject to any disclaimer, the term of this patent is extended or adjusted under 35 U.S.C. 154(b) by 169 days.

(21) Appl. No.: 11/767,498

(22) Filed: Jun. 23, 2007

(65) Prior Publication Data

US 2008/0313995 A1 Dec. 25, 2008

(51) Int. Cl.
*E04B 5/00* (2006.01)
*E04B 2/30* (2006.01)
*E04B 9/00* (2006.01)

(52) U.S. Cl. ..... 52/408; 52/483.1; 52/478

(58) Field of Classification Search ..... 52/408, 52/483.1, 478, 202, 203, 220.4, 264–267, 52/302.1, 409, 411, 506.01, 506.03, 506.04
See application file for complete search history.

(56) References Cited

U.S. PATENT DOCUMENTS 3,302,349 A * 2/1967 Zugehor ..... 52/270
3,755,982 A * 9/1973 Schmidt ..... 52/295
4,122,203 A * 10/1978 Stahl ..... 428/318.4
4,356,675 A * 11/1982 Reicherts ..... 52/264
5,034,085 A * 7/1991 Brauchl ..... 156/293
5,402,615 A * 4/1995 Knott et al. ..... 52/309.1
5,749,187 A * 5/1998 Umehara et al. ..... 52/241
5,768,841 A 6/1998 Swartz et al.
5,927,032 A 7/1999 Record
6,412,247 B1 7/2002 Menchetti et al.
6,901,713 B2 6/2005 Axsom
7,100,342 B2 * 9/2006 Holloway ..... 52/782.1
7,607,271 B2 * 10/2009 Griffin et al. ..... 52/535
2001/0032425 A1 * 10/2001 Terry ..... 52/251

(Continued)

FOREIGN PATENT DOCUMENTS

CH 612239 7/1979

OTHER PUBLICATIONS

Cem-Steel. Datasheet [online]. U.S. Architectural Products, Inc., Jul. 10, 2004. [retrieved on Sep. 16, 2005]. Retrieved from the Internet: <URL: http://architecturalproducts.com/cemsteel.htm>. [62 pages].

*Primary Examiner*—Richard E Chilcot, Jr.
*Assistant Examiner*—Mark R Wendell
(74) *Attorney, Agent, or Firm*—Jerry Turner Sewell

(57) ABSTRACT

In a system and a method for erecting a structure, the walls of the structure are securely interconnected with a foundation, such as, a concrete slab or footing. The system includes a laminated shear panel formed by bonding a thin shear layer (e.g., a layer of sheet steel or other suitable high-strength material) to a surface of a non-structural layer. The thin shear layer has one dimension longer than the non-structural sheet so that a tab of the shear layer extends from one edge of the non-structural sheet. The shear panel is mounted on the exterior walls of a structure with the panel secured to the vertical studs of the wall and with the extended tab secured to the foundation. The shear panel binds the walls of the structure to the foundation to inhibit the walls from lifting or shifting during high wind conditions.

17 Claims, 3 Drawing Sheets

U.S. PATENT DOCUMENTS

2002/0095896 A1* 7/2002 Commins et al. ..... 52/483.1
2005/0086905 A1 4/2005 Ralph et al.
2006/0143998 A1* 7/2006 Timmerman et al. ..... 52/293.3
2007/0044407 A1 3/2007 Elliott et al.
2008/0120932 A1* 5/2008 Paradis ..... 52/309.8
2009/0094909 A1* 4/2009 Cantrell ..... 52/202

* cited by examiner

WALL STRUCTURE FOR PROTECTION AGAINST WIND-CAUSED UPLIFT

BACKGROUND OF THE INVENTION

1. Field of the Invention

This application is directed to wall structures and methods of making wall structures to provide protection against uplift of the wall structures during hurricanes, tornadoes and other high wind conditions.

2. Description of the Related Art

During high winds caused by hurricanes, tornadoes and other extreme weather conditions, one common failure mode of homes and other structures is that the building is lifted from the foundation and then displaced and effectively destroyed. Generally, a structure relies primarily on gravity to maintain the structure on a foundation, such as, for example, a concrete slab, a concrete footing or the like, which is embedded in the ground. The walls of a conventional structure may be anchored to the foundation by a number of hold-down bolts embedded in the concrete and bolted to the mudsill at the base of the wall. One or more of the vertical studs in a wall section may also be bolted to the foundation using hold-down systems such as, for example, the systems described in U.S. Pat. Nos. 4,825,621, 5,388,804, 5,535,561, 6,560,940.

One common issue with the installation of the hold-down bolts and similar systems for anchoring the walls of a structure to a foundation is the cost of the parts and labor required to accomplish the installation and also the need to install the embedded bolt in the concrete when the concrete is poured. In particular, the position of each bolt must be designated in advance, and the bolt must be maintained in a vertical orientation at the designated position until the concrete sets. Then, when the framing of the structure is erected, holes must be formed in the mudsill at the correct locations so that the bolts pass through the mudsill. If the bolts are fastened to vertical studs, the positioning of the bolts must be more precise in order to be disposed alongside the studs.

Because of the costs for the parts and labor, many structures, such as private homes do not include enough hold-down bolts to restrain the structures during high wind conditions. Even if a sufficient number of hold-down bolts are included, only the mudsill or the selected vertical studs are physically connected to the foundation. Thus, when the wind reaches a sufficient intensity or when the wind achieves a resonant condition with the structure, lateral movement of the wall may cause portions of the wall to tear away from the foundation.

SUMMARY OF THE INVENTION

In view of the foregoing, a need exists for a system and method for erecting a structure to more securely bind the walls of the structure to a foundation, such as a concrete footing or a concrete slab.

An aspect of an embodiment disclosed herein is a wall system for a stud-framed structure comprising a shear panel having a thin shear layer bonded to a thicker non-structural layer. The non-structural layer is rectangular and is sized to mount to the studs of a rectangular wall section and to the mudsill of the wall with the thin shear layer in contact with the studs and interposed between the non-structural layer and the studs. The thin shear layer is sized to cover a substantial portion of the non-structural layer and to have at least one tab portion extending beyond at least one edge of the non-structural layer. The tab portion is attachable to a foundation or slab of the structure to secure the shear panel to the foundation or slab. In preferred embodiments, the thin shear layer comprises a sheet of high-strength material, such as, sheet steel having a thickness in a range of approximately 0.015 inch to approximately 0.060 inch or a sheet of another high-strength material having suitable characteristics. In a particularly preferred embodiment, the thin shear layer has a thickness in a range of approximately 0.0179 inch to approximately 0.0389 inch. Still more preferably, the thin shear layer has a thickness of approximately 0.027 inch corresponding to 22 gauge steel. When the high-strength material is steel, the steel may be coated by galvanization, painting or another suitable coating process. Preferably, the thin subsurface shear layer is laminated to a substantially rigid non-structural layer having a thickness in a range of approximately 0.0625 inch to approximately 0.25 inch. Preferably, the non-structural layer has a thickness in a range of 0.0625 inch to approximately 0.1875 inch. Most preferably, the non-structural layer has a thickness of approximately 0.125 inch. The non-structural layer advantageously comprises a medium density fiber board, plywood or another suitable material that is substantially flat and rigid. The thin subsurface shear layer is secured to the non-structural layer by a suitable adhesive to maintain the subsurface shear layer substantially flat when the shear panel is positioned against the studs.

Another aspect of an embodiment disclosed herein is a method of constructing a section of a studded wall system resistant to uplift from wind. The method comprises erecting a plurality of vertical studs secured to a mudsill resting on a concrete foundation or slab. A shear panel having a thin subsurface shear layer bonded to a non-structural layer is secured to the studs with an extended portion of the thin subsurface shear layer extending below the mudsill to a position adjacent to the side of the foundation or slab. The extended portion of the thin subsurface shear layer is secured to the foundation or slab to restrain vertical or lateral movement of the section of the studded wall system.

BRIEF DESCRIPTION OF THE DRAWINGS

The foregoing aspects and other aspects of this disclosure are described in detail below in connection with the accompanying drawing figures in which.

DETAILED DESCRIPTION OF PREFERRED EMBODIMENTS

Figure 1:
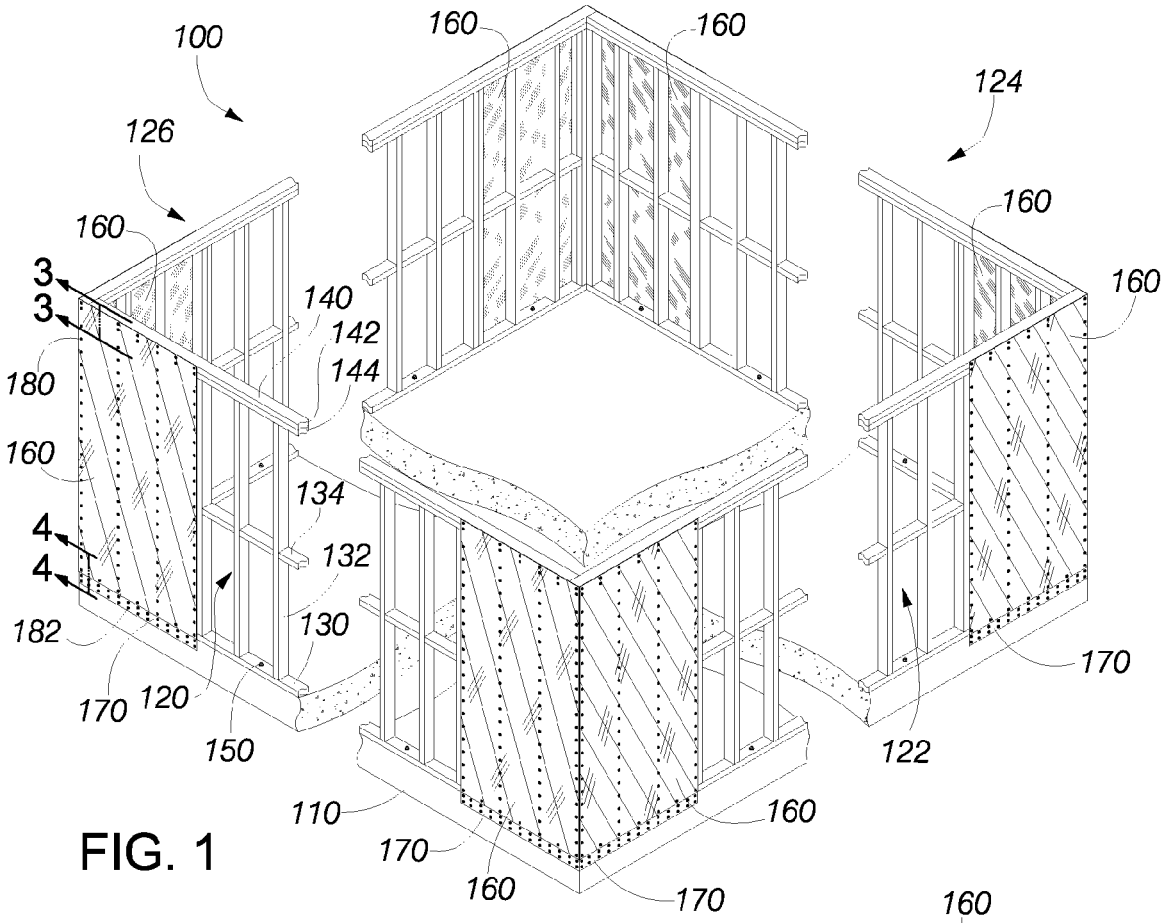
FIG. 1 illustrates a partially broken away perspective view of the four corner portions of the frame of a structure secured to a foundation with a shear panel mounted at each end of each wall of the frame proximate each corner.

FIG. 1 is a perspective illustration of a partially framed structure 100, such as, for example, a residence or a small commercial building. The structure comprises a foundation 110, which is illustrated as a slab in FIG. 1. The slab is shown in partially broken section in FIG. 1 in order to emphasize the shear panels at the corners of the structure. It should be understood that instead of a slab, the foundation may comprise only a perimeter footing or may comprise the above-ground portion of the perimeter walls of a basement.

In FIG. 1, a first side wall 120, a second side wall 122, a third side wall 124 and a fourth side wall 126 are supported by the foundation 110. Each side wall comprises a lower mudsill 130, which rests on the upper surface of the foundation. The mudsill is preferably aligned with the upper edges of the vertical sides of the foundation so that the mudsill does not extend beyond the edge of the foundation and so that the upper surface of the foundation is not exposed proximate the outer edge of the mudsill. In the illustrated embodiment, the mudsill comprises wood, such as, for example, a standard 2×4 (actually 1.5 inches by 3.5 inches) structural member having one or more lengths selected to span the length and width of the foundation. The mudsill may also comprise a metallic structural member.

The mudsill 130 supports a plurality of conventional vertical studs 132, which are spaced apart in a regular conventional manner. In particular, the studs are preferably spaced so that four adjacent studs provide vertical support for a four-foot by eight-foot panel, with one stud at each vertical edge of the panel and two studs being positioned between the first two studs. In the illustrated embodiment, the vertical studs are doubled every four feet to correspond to the edges of the panels. The side walls may also include a plurality of cross members 134 as required by relevant building codes.

A top plate 140 is positioned across the tops of the studs. Preferably, the top plate is approximately twice the thickness of the mudsill. For example, the top plate advantageously comprises an upper top plate layer 142 and a lower top plate layer 144 of 2×4 structural wood to provide a thickness of approximately 3 inches. In a wood frame building, the lengths of the vertical studs 132 are selected for the height of the walls. For example, when conventional 92.25-inch studs are used, the combined height of the mudsill 130, the studs and the top plate produce an overall wall height of approximately 96.75 inches, which is approximately 0.75 inch higher than the length of a standard 8-foot wall panel.

The mudsill 130 is advantageously secured to the foundation by conventional devices. For example, in FIG. 1, the mudsill is secured by a plurality of nut and washer combinations 150, which are attached to bolts embedded in the foundation. A plate (not shown) may be included to increase the surface area of the force applied against the top surface of the mudsill. Although the nuts and washers secure the mudsill to the foundation, the vertical studs 132 of the walls are not secured directly to the foundation. Furthermore, the nuts and washers may not be sufficient to keep the mudsill secured to the foundation under high wind conditions if the walls start to move back and forth. Hold-down devices are available to also connect the studs to the foundation; however, the placement of the hold-down devices with respect to the locations of the studs requires additional labor, and the hold-devices add significant expense to the building construction. The system described herein provides significant wind protection without adding significantly to the construction costs.

As further illustrated in FIG. 1, a plurality of shear panels 160 are positioned on each wall 120, 122, 124, 126 proximate to the corners of the foundation 110. Shear panels are conventionally used in certain regions as protection against movement caused by high winds and earth movement (e.g., movement caused by earthquakes and other seismic events). An exemplary conventional shear panel is disclosed, for example, in U.S. Pat. No. 5,768,841 to Swartz et al., which is incorporated by reference herein. Such conventional shear panels are manufactured to have a thickness in a range of approximately 0.5 inch to approximately 0.625 inch so that the shear panel can be installed in lieu of conventional plywood panels on a building structure. However, because of the thickness, the conventional shear panels are not suitable for structures that do not have a corresponding thickness of regular paneling adjacent the shear paneling. For example, if the exterior walls of a structure are plastered or have siding attached, the thickness of the conventional shear panels on one portion of a wall may require the remaining portions of the wall to be shimmed with furring strips or the like to achieve a uniform thickness before the finish is applied.

The shear panels 160 in FIG. 1 are not conventional shear panels. Rather, as shown in more detail in FIGS. 2, 3 and 4, each shear panel 160 in FIG. 1 differs from the patented shear panels by utilizing a rigid non-structural layer 162 that is not as thick as the previously known shear panel. The non-structural layer is laminated to a thin shear layer 164.

The non-structural layer 162 advantageously comprises a thin sheet of medium density fiber board (MDF), plywood, magnesium oxide board, or other suitable material, which is easily handled using conventional construction techniques. For example, magnesium oxide board is advantageously used in certain embodiments because the magnesium oxide board does not mold or burn. The non-structural layer advantageously has a thickness in a range of approximately 0.0625 inch to approximately 0.25 inch. Preferably, the thickness of the non-structural layer is in a range of approximately 0.0625 inch to approximately 0.1875 inch. More preferably, the thickness of the non-structural layer is about 0.125 inch. The non-structural layer is formed as a sheet having a size that conforms with the size of a conventional structural panel. For example, the non-structural layer advantageously has a width of approximately 48 inches and has a length corresponding to the height of the side walls 120, 122, 124, 126. For example, the length of the non-structural layer advantageously is one of 8 feet, 9 feet, 10 feet or 12 feet. The length of the non-structural layer may be advantageously formed in a non-conventional size when the side walls have a non-conventional length.

Figure 2:
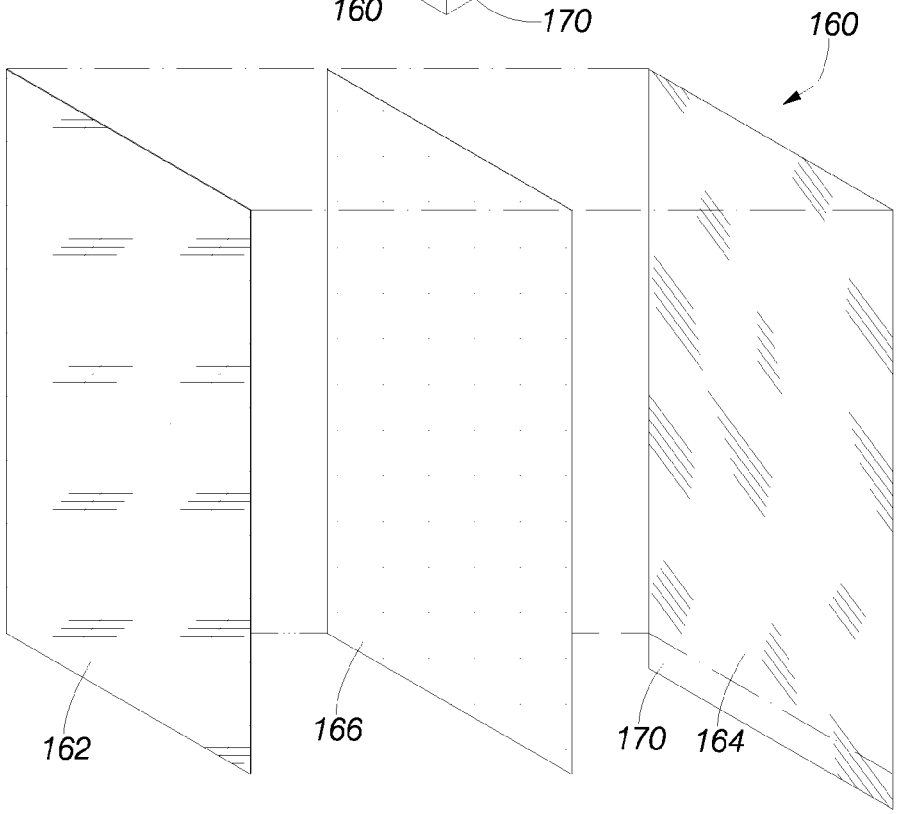
FIG. 2 illustrates an exploded perspective view of one of the shear panels of FIG. 1 showing a non-structural layer, an adhesive layer, and a shear layer, wherein the length of the shear layer is longer than the length of the non-structural layer.
Figure 3:
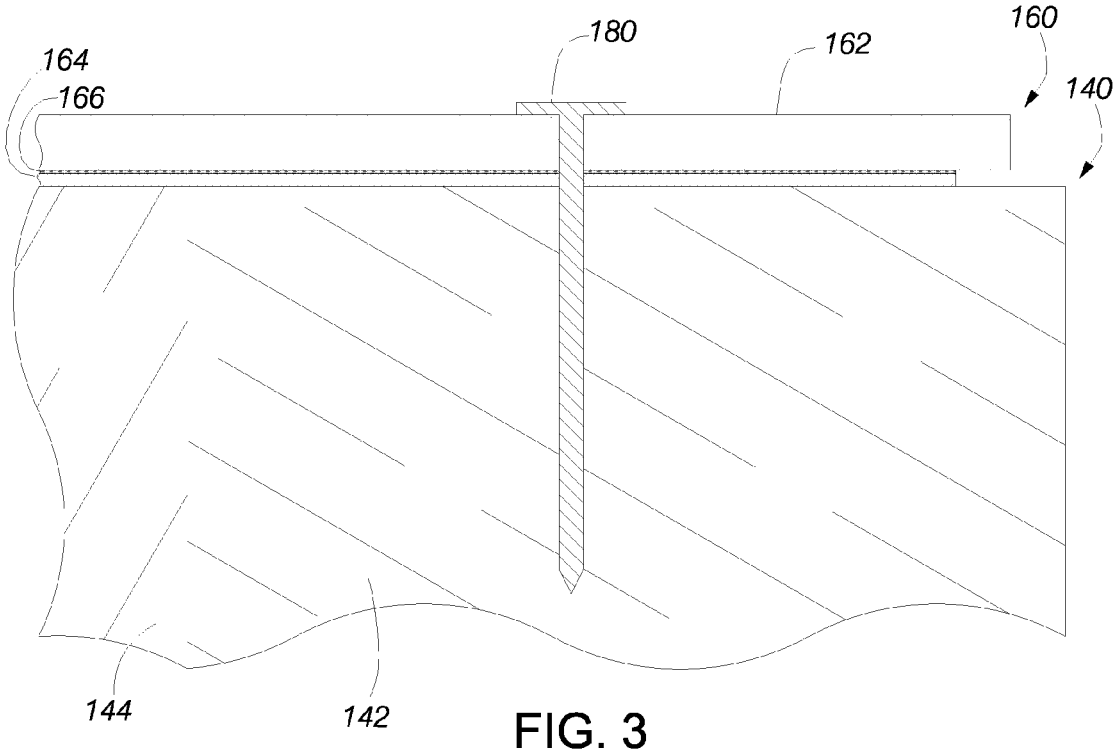
FIG. 3 illustrates an enlarged cross-sectional view of the upper portion of one of the shear panels of FIG. 1 taken along the lines 3-3 in FIG. 1 and showing the layers of the shear panel in more detail.
Figure 4:
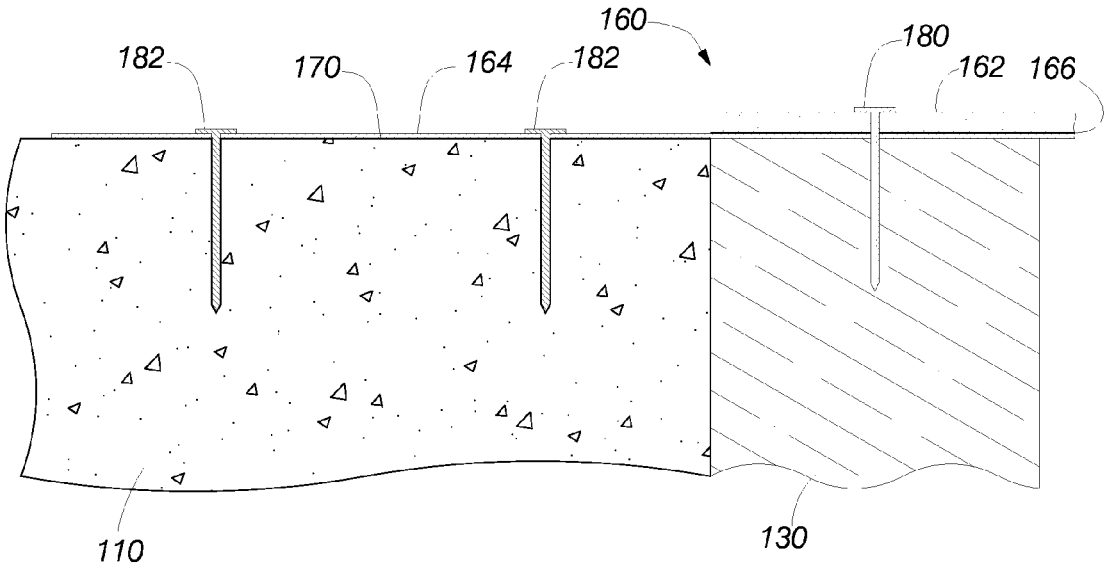
FIG. 4 illustrates an enlarged cross-sectional view of the lower portion of one of the shear panels of FIG. 1 taken along the lines 4-4 in FIG. 1 and showing the tab layer of the shear panel in more detail.

As further illustrated in FIGS. 2, 3 and 4, the non-structural layer 162 of the shear panel 160 is laminated (e.g., bonded) to the thin shear layer 164. In the illustrated preferred embodiment, the thin shear layer comprises a thin steel sheet or a sheet of another high-strength material having suitable characteristics. In certain preferred embodiments comprising a shear layer 164 of steel sheet, the steel sheet is preferably coated (e.g., by galvanization, by painting or by other suitable coating processes). The steel sheet advantageously has a thickness in a range of approximately 0.015 inch to approximately 0.060 inch, and preferably has a thickness in a range of approximately 0.0179 inch to approximately 0.0389 inch. More preferably, the steel sheet has a thickness of approximately 0.027 inch, which corresponds to 22 gauge steel.

The shear layer 164 has a width that is approximately the same as the width of the non-structural layer 162; however, in preferred embodiments, the width of the shear layer is slightly less than the width of the non-structural layer so that when the shear layer is centered on the surface of the non-structural sheet, the side edges (e.g., the long edges) of the shear layer are inset from the side edges of the non-structural layer. For example, the side edges of the shear layer may be inset by approximately 0.0626 inch to approximately 0.125 inch from the side edges of the structural layer so that the potentially sharp edges of the shear layer (e.g., the steel sheet in the preferred embodiment) are not exposed when the shear panel 160 is handled at a construction site. The upper edge of the shear layer (the edge of the shorter side to be installed on one of the top plates 140 of the structure 100) is also preferably offset by approximately the same amount from the upper edge of the non-structural sheet.

As illustrated in FIG. 2, each shear panel 160 is formed by laminating the shear layer 164 to a rear surface (when viewed from the outside of the wall onto which the shear panel is mounted) of the non-structural layer 162 using a suitable adhesive layer 166. The adhesive layer is illustrated as a sheet in FIG. 2, but the adhesive layer is advantageously formed by rolling, brushing or spraying a liquid adhesive onto a surface of the non-structural panel prior to placement of the shear layer. After applying the shear layer over the adhesive layer, pressure is applied to the three layers so that the shear layer is secured as a substantially flat layer against the non-structural layer. Thus, the thin shear layer is easily handled and is maintained substantially flat when the shear panel is positioned against the vertical studs 132.

As illustrated in FIGS. 1, 2 and 4, the shear panel 160 further differs from the conventional shear panel because only an upper portion of the shear layer 164 is bonded to the rear surface of the non-structural layer 162. In particular, the shear panel includes an extended, unbonded portion of the shear layer that forms a tab 170 at the lower end of the shear panel. In the illustrated embodiment, the tab has a length of approximately 4 inches such that when the non-structural layer has a length of approximately 8 feet (96 inches), the steel layer has an overall length of approximately 100 inches. As described below, the tab is used to provide wind uplift protection when the shear panel is installed on the structure 100.

Preferably, one of the shear panels 160 is positioned at each end of each of the walls 120, 122, 124, 126 at the corners where two walls meet. Each shear panel is positioned with the shear layer 164 against the studs 132. The top and the bottom of the non-structural layer 162 of each shear panel are aligned in a conventional manner with the top plate 140 and the mudsill 130. As illustrated in FIGS. 1 and 4, when the shear panel is aligned in this manner, the tab 170 of the shear layer extends below the mudsill and is positioned against the bare concrete along the side of the foundation 110.

As illustrated in FIG. 1 and FIG. 3, each shear panel 160 is secured to the top plate 140 and to the studs 132 using a plurality of fasteners 180 (e.g., nails, screws or the like) suitable to the material comprising the top plate and the studs. As illustrated in FIG. 1 and FIG. 4, the tab 170 of the steel shear layer 164 is secured to the concrete foundation 110 using a plurality of fasteners 182 suitable for penetrating or engaging concrete, such as, for example, concrete nails, masonry screws, or the like. Accordingly, the shear panels function as large straps to secure the corner of one of the walls 120, 122, 124, 126 to the foundation. The non-structural layer 162 in the shear panel assures that the steel shear layer is installed substantially flat against the top plate and the studs and is maintained in flat condition after installation.

During high winds, the secure coupling between the concrete foundation 110 and the studs 132 and top plate 140 provided by the steel shear layer 164 of each shear panel 160 substantially reduces or eliminates any tendency of the side walls to lift from the foundation. Furthermore, the steel layer interconnects the studs, the top plate and the mudsill to provide the rigidity of the conventional shear panel described in the above-referenced patent to Swartz et al., thus reducing any tendency of the side walls to lean away from the pressure of the wind.

As discussed above, the overall thickness of the shear panel 160 is preferably less than approximately 0.1875 inch. Accordingly, conventional exterior wall materials (e.g., insulating boards, lap siding, masonry siding, plaster siding or the like) may be positioned directly over the shear panel. In some installations, a thin layer of shim material may be placed on the first vertical stud 132 adjacent the edge of the shear panel to obviate an abrupt transition in the offset of the wall material being installed over the shear panel and the wall material being installed on an adjacent stud not covered by the shear panel. On subsequent studs, the difference between the thicknesses with and without the underlying shear panel should not require additional shimming. In general, the difference in thickness caused by the shear panel is not significantly greater than a difference in thickness that may occur in conventional wall systems because of variations in the wall thickness caused by non-uniform studs and caused by non-uniform placements of the studs on the mudsill.

The tab 170 and the fastening devices 182 extending over the side of the concrete foundation 110 are advantageously covered with plaster or another suitable finishing materials when the siding or other finish material is installed on the side walls.

As described above, the improved shear panel 160 is easily installed on the structure 100 in accordance with conventional construction techniques. The shear panel does not require any additional hold-down devices to be placed in the foundation 110 when the concrete is poured. The normal number of embedded bolts and nut and washer combinations 150 that secure the mudsill 130 to the foundation are adequate when used in combination with the improved shear panel. The shear panel is readily installed by the framers of the structure. The shear panel does not require any significant adaptation in the procedures used when the outer wall material is installed because the overall thickness of the shear panel is sufficiently thin to allow conventional wall materials to be installed directly over the shear panel. Because of the effectively large size of the "strap" provided by each shear panel, the shear panel provides a substantial benefit in securing the walls of the structure to the foundation during high wind conditions.

Figure 5:
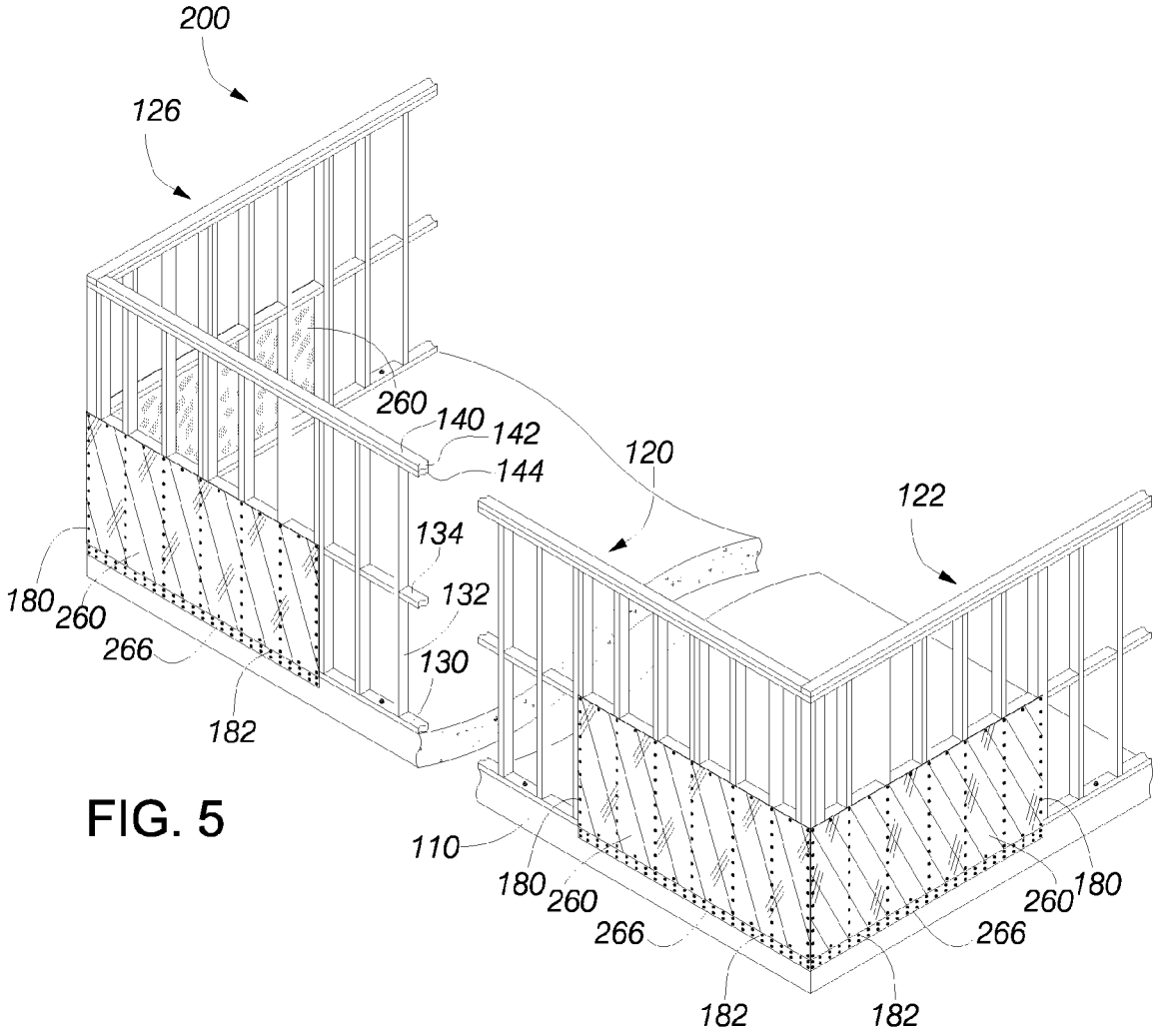
FIG. 5 illustrates a partial perspective view of the frame of a structure secured to a foundation with a shear panel having a tab along a longer horizontal edge and with the height of the shear panel less than the height of the studs forming the walls of the structure.

In FIGS. 1-4, each shear panel 160 has the lower tab 170 formed as an extension of one of the edges having the narrower width (e.g., along a 4-foot edge of a 4 foot by eight foot panel). Accordingly, the shorter edges of the shear panel are positioned horizontally. In some circumstances, an architect or contract may choose to position a shear panel with the longer edges of the shear panel horizontally. As illustrated for a structure 200 in FIG. 5, a shear panel 260 may be constructed with a tab 266 extending along the long edge so that the shear panel may be installed horizontally. Such an installation technique is useful, for example, for longer walls in order to provide additional interconnections to the foundation.

One skilled in art will appreciate that the foregoing embodiments are illustrative of the present invention. The present invention can be advantageously incorporated into alternative embodiments while remaining within the spirit and scope of the present invention, as defined by the appended claims.

We claim:

1. A wind-resistant studded wall for a structure comprising:

a horizontal mudsill mounted on a foundation;

a plurality of vertical studs mounted on the mudsill; and a shear panel mounted on a portion of the studs, the shear panel comprising an outer non-structural layer and an inner shear layer, the outer non-structural layer having first and second surfaces defined between a first edge, a second edge, a third edge and a fourth edge, the inner shear layer comprising a high-strength material having first and second surfaces defined between a first edge, a second edge, a third edge and a fourth edge, a first portion of the first surface of a first portion of the shear layer bonded to the second surface of the non-structural layer with the first edge of the shear layer positioned proximate the first edge of the non-structural layer, the second edge of the shear layer positioned proximate the second edge of the non-structural layer, the third edge of the shear layer positioned proximate the third edge of the non-structural layer, and the fourth edge of the shear layer extending beyond the fourth edge of the non-structural layer to form an unbonded tab portion of the shear layer, the non-structural layer sized to mount on the studs above the foundation with the first portion of the shear layer between the non-structural layer and the studs and with the unbonded tab portion of the shear layer extending below the non-structural layer and proximate to a side of the foundation, the upper portion of the shear layer secured to the vertical studs with fasteners passing through the non-structural layer, the unbonded tab portion of the shear layer secured directly to the foundation with a plurality of fasteners passing through the unbonded tab portion.

2. The wind-resistant studded wall as defined in claim 1, wherein the shear layer comprises sheet steel having a thickness in a range of approximately 0.015 inch to approximately 0.060 inch.

3. The wind-resistant studded wall as defined in claim 1, wherein the shear layer comprises sheet steel having a thickness in a range of approximately 0.0179 inch to approximately 0.0389 inch.

4. The wind-resistant studded wall as defined in claim 1, wherein the shear layer comprises sheet steel having a thickness of approximately 0.027 inch.

5. The wind-resistant studded wall as defined in claim 1, wherein the shear layer comprises galvanized sheet steel.

6. The wind-resistant studded wall as defined in claim 1, wherein the non-structural layer is substantially rigid and has a thickness in a range of approximately 0.0625 inch to approximately 0.25 inch.

7. The wind-resistant studded wall as defined in claim 1, wherein the non-structural layer is substantially rigid and has a thickness in a range of approximately 0.0625 inch to approximately 0.1875 inch.

8. The wind-resistant studded wall as defined in claim 1, wherein the non-structural layer is substantially rigid and has a thickness in a range of approximately 0.125 inch.

9. The wind-resistant studded wall as defined in claim 1, wherein the non-structural layer comprises a medium density fiber board.

10. The wind-resistant studded wall as defined in claim 1, wherein the non-structural layer comprises plywood.

11. The wind-resistant studded wall as defined in claim 1, wherein the non-structural layer comprises magnesium-oxide board.

12. The wind-resistant studded wall as defined in claim 1, wherein the shear layer is bonded to the non-structural layer by an adhesive.

13. The wind-resistant studded wall as defined in claim 1, wherein the vertical studs comprise wood.

14. The wind-resistant studded wall as defined in claim 1, wherein the vertical studs comprise steel.

15. A method of constructing a section of a studded wall system resistant to uplift from wind comprising:

erecting a plurality of vertical studs secured to a mudsill resting on a foundation;

securing a shear panel to the vertical studs, the shear panel comprising:

an outer non-structural layer having first and second surfaces defined between a first edge, a second edge, a third edge and a fourth edge; and an inner shear layer comprising a high-strength material having first and second surfaces defined between a first edge, a second edge, a third edge and a fourth edge, a first portion of the first surface of the shear layer bonded to the second surface of the non-structural layer with the first edge of the shear layer positioned proximate the first edge of the non-structural layer, the second edge of the shear layer positioned proximate the second edge of the non-structural layer, the third edge of the shear layer positioned proximate the third edge of the non-structural layer, and the fourth edge of the shear layer extending beyond the fourth edge of the non-structural layer to form an unbonded tab portion of the shear layer; and securing the unbonded portion of the shear layer directly to the foundation with a plurality of fasteners to restrain vertical and lateral movement of the section of the studded wall system.

16. The method as defined in claim 15, wherein the vertical studs comprise wood.

17. The method as defined in claim 15, wherein the vertical studs comprise steel.

* * * * *

UNITED STATES PATENT AND TRADEMARK OFFICE
Certificate

Patent No. 7,658,045 B2 Patented: February 9, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: A. Carleton Elliott, Newport Beach, CA (US); Kelly P. Holcomb, Huntington Beach, CA (US); Allan J. Swartz, Gardnerville, NV (US); and Gregory Kulpa, Tustin, CA (US).

Signed and Sealed this Thirtieth day of November 2010.

BRIAN GLESSNER
*Supervisory Patent Examiner*
Art Unit 3633
Technology Center 3600